US007922145B2

(12) United States Patent
Martin

(10) Patent No.: US 7,922,145 B2
(45) Date of Patent: Apr. 12, 2011

(54) ADJUSTABLE SUPPORT STAND FOR PRE-CAST CONCRETE WALL FORMS

(75) Inventor: Steven L. Martin, Ephrata, PA (US)

(73) Assignee: SWA Holding Company, Inc., Wilmington, DE (US)

( * ) Notice: Subject to any disclaimer, the term of this patent is extended or adjusted under 35 U.S.C. 154(b) by 319 days.

(21) Appl. No.: 12/027,112

(22) Filed: Feb. 6, 2008

(65) Prior Publication Data

US 2009/0194665 A1 Aug. 6, 2009

(51) Int. Cl.
*E04G 11/00* (2006.01)
*A47F 5/10* (2006.01)
*B28B 7/22* (2006.01)

(52) U.S. Cl. ..... 249/120; 249/24; 249/126; 249/139; 249/167; 249/219.1; 248/422; 248/424; 248/176.3; 248/327; 248/339; 248/294.1

(58) Field of Classification Search ..... 249/24, 249/34, 48–51, 74, 76, 91, 95, 120, 126, 249/127, 136, 139, 155, 189, 192, 193, 212, 249/216, 219.1, 18, 163–169, 217; 52/111, 52/114, 117, 126.1, 126.3–126.5, 126.7, 52/127.6–127.8, 365, 745.12, 745.2, 837; 248/125.8, 157, 161, 188, 339, 346.06, 354.1, 248/354.4, 422, 679, 122.1, 424, 177.1, 176.3, 248/294.1, 304–306, 322, 327
See application file for complete search history.

(56) References Cited

U.S. PATENT DOCUMENTS 1,585,642 A * 5/1926 Bello ..... 425/399
3,241,815 A * 3/1966 Hammond ..... 254/419
3,655,161 A * 4/1972 Schueler ..... 254/100
3,815,858 A * 6/1974 Mocny et al. ..... 248/295.11
3,900,179 A * 8/1975 Mocny et al. ..... 248/287.1
3,998,028 A * 12/1976 Pelletier et al. ..... 52/834
4,284,293 A * 8/1981 Rygajlo ..... 248/354.2
4,404,780 A * 9/1983 Josephson ..... 52/126.7
4,581,863 A * 4/1986 Thaler ..... 52/126.2
4,866,797 A * 9/1989 Vollan ..... 52/126.6
4,870,789 A * 10/1989 Clark et al. ..... 52/126.6
4,882,887 A * 11/1989 Giles et al. ..... 52/126.6
5,056,750 A * 10/1991 Ellithorpe ..... 248/354.3
5,085,398 A * 2/1992 Holcomb et al. ..... 249/24
5,238,266 A * 8/1993 VanDenberg ..... 280/766.1
5,271,596 A * 12/1993 Holcomb et al. ..... 249/24
5,515,655 A * 5/1996 Hoffmann ..... 52/126.6
5,542,647 A * 8/1996 Huetsch ..... 254/420
(Continued)

*Primary Examiner* — Joseph S Del Sole
*Assistant Examiner* — Dimple Bodawala
(74) *Attorney, Agent, or Firm* — Miller Law Group, PLLC

(57) ABSTRACT

An adjustable support stand is mounted on a pre-cast concrete wall panel form to facilitate the leveling of the form and the support of the form about the production plant floor. The adjustable support stand includes a frame portion that houses a threaded rod positional fixed for rotation within the frame portion to drive a vertical movement of the leg member in response to rotation of the threaded rod. The adjustable support stand further includes a clamping apparatus that detachably mounts the frame portion to the flanges of a steel beam frame member. The actuator member can be a nut welded to the top of the threaded rod to affect movement of the engaged leg member in response to manipulation with a powered or manually operated hand tool, or a gear set and an orthogonal drive shaft that transfers rotation from a hand tool to the threaded rod.

11 Claims, 7 Drawing Sheets

U.S. PATENT DOCUMENTS 5,569,472 A * 10/1996 Cerboni ..... 425/404
5,595,366 A * 1/1997 Cusimano et al. ..... 248/354.3
5,656,194 A 8/1997 Zimmerman
5,727,767 A * 3/1998 Jefrey ..... 248/354.3
5,826,847 A * 10/1998 Warner et al. ..... 248/354.1
5,862,635 A * 1/1999 Linse et al. ..... 52/126.6
6,094,873 A * 8/2000 Hoffman et al. ..... 52/126.6
6,347,489 B1 * 2/2002 Marshall et al. ..... 52/169.9
6,349,512 B1 * 2/2002 Berkey et al. ..... 52/126.6
6,381,907 B1 * 5/2002 MacKarvich ..... 52/126.6
6,397,535 B1 * 6/2002 Kim et al. ..... 52/250
6,494,004 B1 12/2002 Zimmerman
6,832,746 B2 * 12/2004 McCracken et al. ..... 248/357
6,871,454 B2 * 3/2005 Coday et al. ..... 52/126.6
2005/0056760 A1 * 3/2005 Carlson ..... 248/354.3
2005/0202923 A1 * 9/2005 Drake ..... 475/269
2007/0176059 A1 * 8/2007 Roscetti et al. ..... 248/122.1

* cited by examiner

ADJUSTABLE SUPPORT STAND FOR PRE-CAST CONCRETE WALL FORMS

FIELD OF THE INVENTION

The present invention relates generally to the pre-cast concrete wall systems and, more particularly, to a support stand that locates the forms for manufacturing pre-cast concrete walls in an elevated position above the floor.

BACKGROUND OF THE INVENTION

Pre-cast concrete wall systems are known in the art, as can be found, for example, in U.S. Pat. No. 6,494,004, issued to Melvin Zimmerman on Dec. 17, 2002. Such pre-cast concrete walls are typically used as basement walls for building structures, for example, houses and commercial buildings. Such walls are manufactured in a production plant by assembling non-concrete components into a form and pouring concrete into the form to encapsulate the non-concrete components. Once the concrete has hardened, the manufactured wall is stripped away from the form and the wall panel is transported to the job site for installation. Typically, a plurality of wall panels is assembled on the job site to form a basement structure of the building to be constructed thereon.

The formation of the pre-cast concrete walls at the production plant requires a form that is typically constructed of steel to support the non-concrete components, such as reinforcement rods, insulation panels, wall studs, etc., and the concrete that is poured into the form to create the pre-cast wall panels. Once the concrete is hardened, the wall can be stripped away. The form is then re-used for subsequent pre-cast wall panel production and the process repeated. An example of the forms for creating pre-cast concrete wall panels can be found in U.S. Pat. No. 5,656,194, granted on Aug. 12, 1997, to Melvin M. Zimmerman.

Some forms for the production of concrete wall panels are constructed with a laterally movable side member that can be selectively positioned to adjust the overall width of the pre-cast concrete wall panel to be formed. This movable side member, as well as the remainder of the form, is supported by a steel beam that provides the basic framework for the support of the form at a location above the floor of the production plant to facilitate the use of the form in the manufacture of the pre-cast concrete wall panels. The steel beam frame members are supported above the production plant floor by support legs that are typically welded onto the steel beam frame members. With a fixed form, i.e. one that does not have a movable side member, the form is not typically moved from one location to another within the production plant and fixed length legs are usually sufficient to support the form at the elevated location above the floor in a planar configuration.

The utilization of a laterally movable side member, however, adds some complexity in the stabilization of the forms, as well as maintaining a planar configuration so that the pre-cast concrete walls manufactured therefrom are constructed in a planar shape for proper assembly at the job site. Production plant floors are typically uneven. Thus, when the laterally movable side member is re-positioned to create a pre-cast wall panel that has a different width than the previous one constructed from the form, a fixed length support leg may not provide the proper support of the movable steel beam frame to maintain a planar configuration of the pre-cast wall to be constructed. Thus, when the movable side member is re-positioned, shimming the support leg to maintain proper positioning of the movable side member results in lost production time.

Support legs can also be deformed or bent during the manufacturing process, such as when impacted by machinery used to move the hardend pre-cast concrete wall panels. Since the proper positioning of the form, including the steel beam frame members, is necessary for the manufacture of the pre-cast concrete wall panels, these support legs, which are typically welded onto the steel beam frame members, need to be cut off and a new support leg installed at the correct length or height to maintain the proper configuration of the form.

Accordingly, it would be desirable to provide a support leg structure for a form used in the production of pre-cast concrete wall panels that would facilitate rapid deployment and replacement when the support legs need to be adjusted or replaced.

SUMMARY OF THE INVENTION

It is an object of this invention to overcome the aforementioned disadvantages of the known prior art by providing an adjustable length support stand for use on pre-cast concrete wall panel forms.

It is another object of this invention to provide a support stand for a pre-cast concrete wall panel form that has a frame portion connectable to the form and a leg member movable relative to the frame portion.

It is still another object of this invention to provide a frame portion of a support leg for a pre-cast concrete wall panel form that is detachable from a steel beam frame member of the form.

It is a feature of this invention that the adjustable support stand has a leg member that is movable relative to the frame portion of the support stand.

It is an advantage of this invention that the leg member has a floor engaging foot that can be vertically positioned relative to the frame portion of the support stand.

It is another feature of this invention that the support stand has the leg member threaded into the frame portion of the support stand.

It is another advantage of this invention that the vertically adjustable leg member will permit the pre-cast concrete wall panel form to be leveled irrespective of any variations in the production plant floor.

It is still another feature of this invention that the leg member is formed with an actuator member that enables the leg member to be moved through powered or manually operated tools.

It is yet another feature of this invention that one embodiment of the actuator member is a nut welded to the top of a threaded rod operatively engaged with the vertically movable leg member.

It is still another feature of this invention that another embodiment of the actuator member includes a drive shaft mounted for rotation orthogonally to the threaded rod with a gear set operable interconnecting the drive shaft and the threaded rod engaged with the leg member to permit the transfer of rotation from the drive shaft to the threaded rod for positional adjustment of the leg member.

It is still another advantage of this invention that the movement of the leg member of the adjustable support stand can be utilized to level the pre-cast concrete wall panel form.

It is yet another advantage of this invention that the vertical movement of the leg member can be accomplished easily and conveniently through the manipulation of the actuator member through powered or manually operated hand tools.

It is a further feature of this invention that the frame portion of the adjustable support stand is provided with a clamping apparatus to detachably connect the adjustable support stand to the steel beam frame member of a pre-cast concrete wall panel form.

It is yet another advantage of this invention that the support stand can be detached from the steel beam frame member of the pre-cast concrete wall panel form.

It is still another advantage of this invention that the clamping apparatus enables the support stand to be positioned along the steel beam frame member at a desired or advantageous location.

It is a further advantage of this invention that the clamping mechanism can permit the support stand to be replaced if necessary by releasing the clamping apparatus.

It is a further feature of this invention that the clamping apparatus includes first and second clamp members interconnected by fasteners that can draw the two clamp members together to secure the clamping apparatus on the flanges of a steel beam frame member.

It is yet another object of this invention to provide an adjustable support stand for a pre-cast concrete wall panel form that is durable in construction, inexpensive of manufacture, carefree of maintenance, facile in assemblage, and simple and effective in use.

These and other objects, features and advantages are accomplished according to the instant invention by providing an adjustable support stand for mounting on a pre-cast concrete wall panel form to facilitate the leveling of the form and the support of the form about the production plant floor. The adjustable support stand includes a frame portion that houses a threaded rod positional fixed for rotation within the frame portion to drive a vertical movement of the leg member in response to rotation of the threaded rod. The adjustable support stand further includes a clamping apparatus that detachably mounts the frame portion to the flanges of a steel beam frame member. The actuator member can be a nut welded to the top of the threaded rod to affect movement of the engaged leg member in response to manipulation with a powered or manually operated hand tool, or a gear set and an orthogonal drive shaft that transfers rotation from a hand tool to the threaded rod.

BRIEF DESCRIPTION OF THE DRAWINGS

The foregoing and other objects, features, and advantages of the invention will appear more fully hereinafter from a consideration of the detailed description that follows, in conjunction with the accompanying sheets of drawings. It is to be expressly understood, however, that the drawings are for illustrative purposes and are not to be construed as defining the limits of the invention.

DETAILED DESCRIPTION OF THE PREFERRED EMBODIMENT

Figure 2:
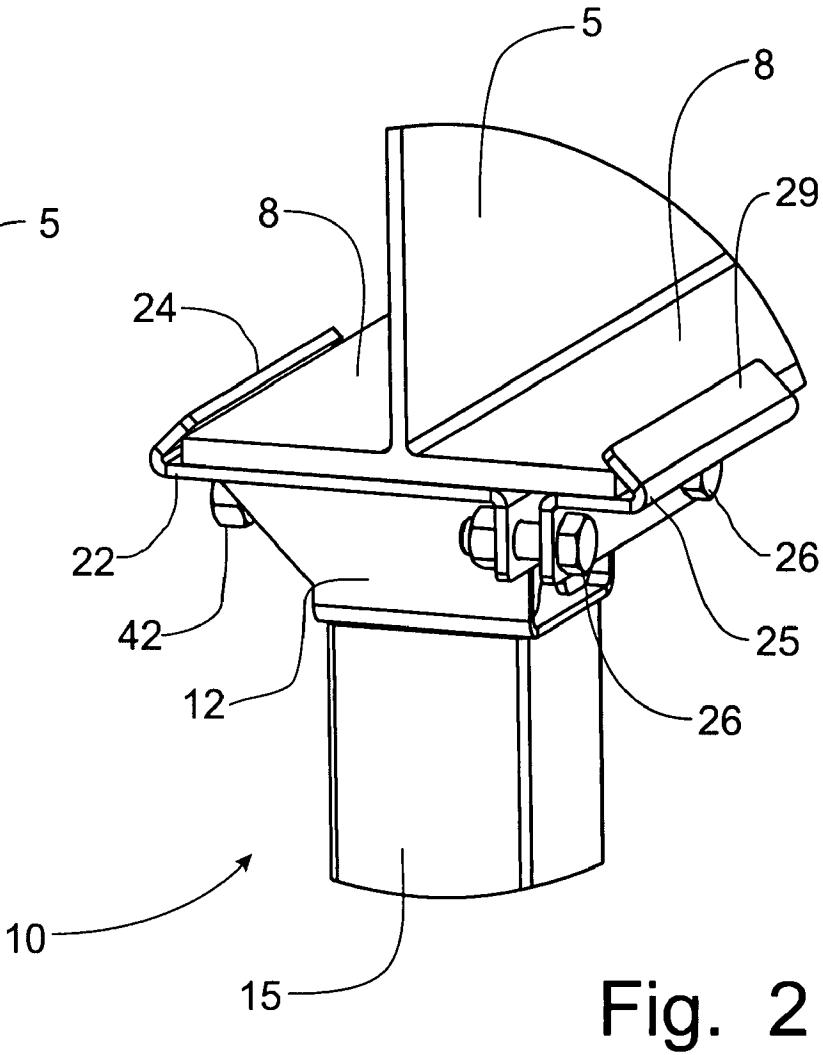
FIG. 2 is an enlarged partial perspective view of the end of the steel beam depicted in FIG. 1 to show the frame portion of the adjustable support stand having a clamping apparatus mounted on the flanges of the steel beam.
Figure 1:
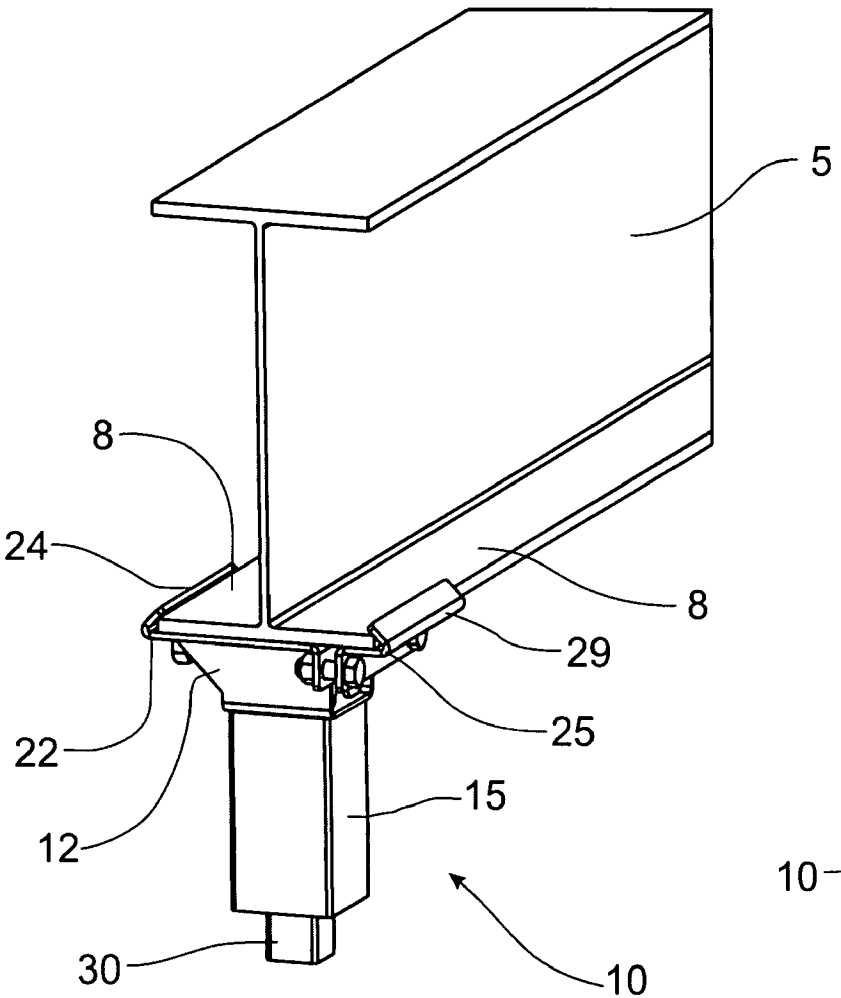
FIG. 1 is a partial perspective view of a steel beam frame member from a form assembly used to manufacture a pre-cast concrete wall panel member, the steel beam having an adjustable support stand incorporating the principles of the instant invention mounted thereon.
Figure 4:
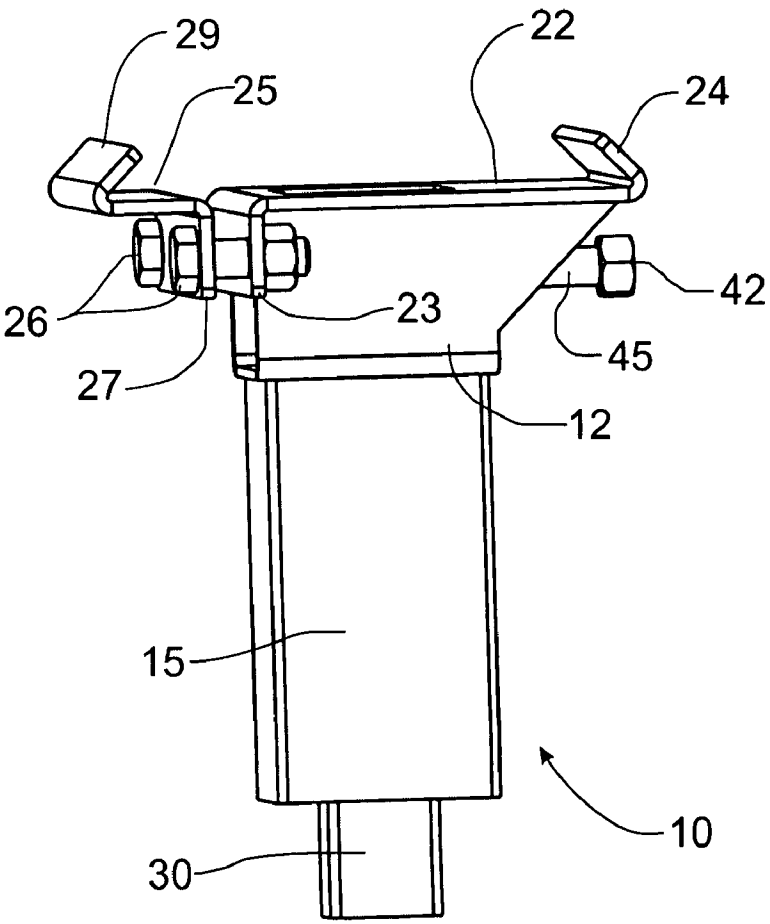
FIG. 4 is a perspective view of the adjustable support stand to depict the clamping apparatus at the top of the frame portion of the support stand.
Figure 3:
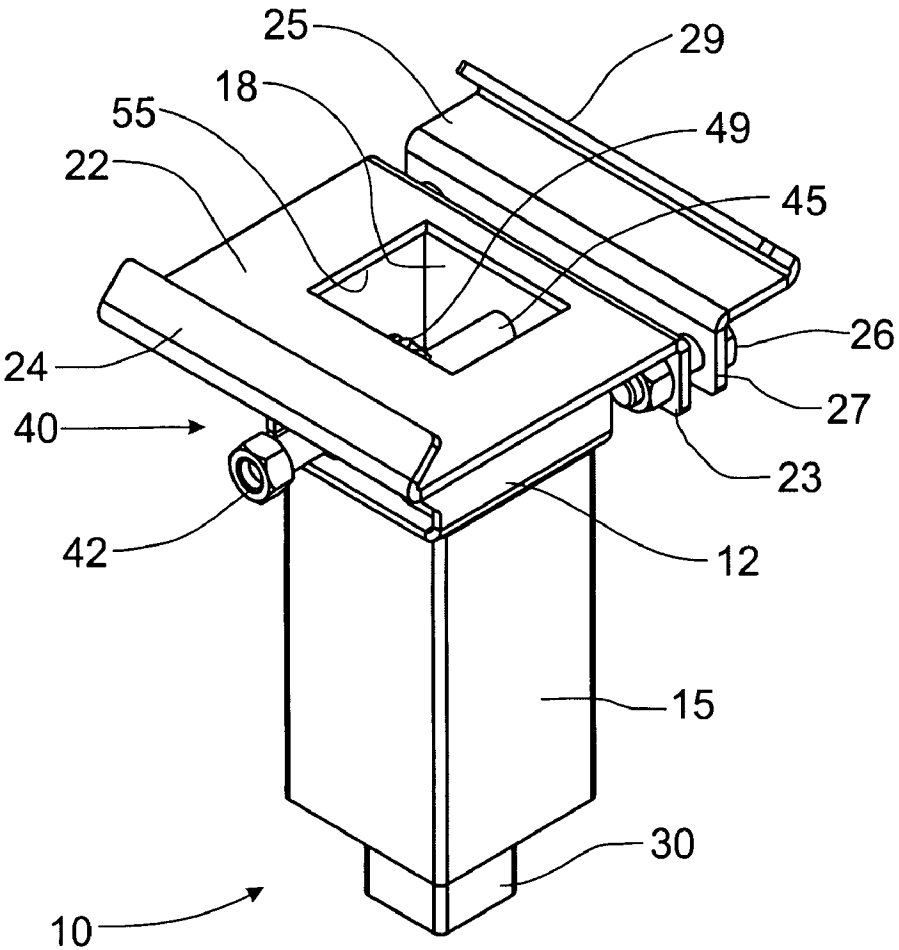
FIG. 3 is an upper perspective view of the adjustable support stand to depict the clamping apparatus and a first embodiment of the actuation member.

Referring to FIGS. 1-7, an adjustable support stand, incorporating the principles of the instant invention, for mounting on a steel beam frame member of a form used to manufacture a pre-cast concrete wall panel member can best be seen. The steel beam 5 is shown in FIGS. 1 and 2 and represents a conventional form assembly for a pre-cast concrete wall panel (not shown), as is known in the art. An example of a pre-cast concrete wall panel (not shown) can be found in U.S. Pat. No. 6,494,004, issued to Melvin M. Zimmerman on Dec. 17, 2002, the contents of which are incorporated herein by reference. The adjustable support stand 10 has particular use on a form assembly that incorporates a laterally movable side member (not shown) that can be positioned relative to the rest of the form structure to select the width of the pre-cast concrete wall panel being manufactured in the form. Such a form assembly with a laterally movable side member is known in the art.

The adjustable support stand 10 is preferably constructed of sheet steel welded into the form depicted in the drawings to provide adequate strength in use and economy in manufacture. The adjustable support stand 10 is formed with a frame portion 15 that incorporates a clamping apparatus 20 at the uppermost portion thereof for engaging and mounting to the flanges 8 of the steel beam frame member 5. The clamping apparatus 20 includes a fixed clamp member 22 welded to the frame portion 15 and having a hooked portion 24 that slips around the edge of the flange 8. A movable clamp member 25 is secured to the fixed clamp member 22 by fasteners 26 that interconnect mounting tabs 23, 27 formed on the fixed clamp member 22 and the movable clamp member 25, respectively. The movable clamp member 25 is also formed with a hook portion 29 that engages the opposing flange 8 of the steel beam 5 opposite the hook portion 24 of the fixed clamp member 22. The fasteners 26 are operable to either bring the two mounting tabs together or to draw the two hook portions 24, 29 tight against the flanges 8 of the steel beam 5 to mount the support stand 10 on the steel beam 10.

Placement of the support stand 10 on the steel beam 5 requires that the fasteners 26 be manipulated to separate the movable clamp member 25 away from the fixed clamp member 22 sufficiently to fit around the flanges 8 of the steel beam 5. The hook portions 24, 29 are engaged on the flanges 8 and the fasteners 26 manipulated to draw the movable clamp member 25 toward the fixed clamp member 22 until the clamp apparatus 20 is tightly secured to the steel beam 5. Removal of the support stand 10 is simply the reverse of the installation procedure with the fasteners 26 being loosened until the hook portions 24, 29 can be disengaged from the steel beam 5. Accordingly, the support stand 10 can be easily replaced in the event of damage.

The floor of production plants are typically uneven and the form for the pre-cast concrete wall panel needs to be leveled to allow the poured concrete to level within the form. Accordingly, providing support stands 10 that are capable of vertical adjustment would facilitate initial form set up. Furthermore, some forms are provided with a laterally movable side member (not shown) that can be located, or laterally positioned, to provide varying widths for the pre-cast concrete wall panel being constructed. Each time this movable side member is re-located, the form has to be leveled for proper construction of the pre-cast concrete wall panel. Therefore, the adjustable support stand 10, incorporating the principles of the instant invention, will permit a more rapid deployment of the movable side member, particularly when the production floor is uneven.

As is best seen in FIGS. 3-7, the frame portion 15 includes a pair of gussets 16, 17 at the lower portion of the frame portion 15 to guide the leg member 30 for vertical movement relative to the frame portion 15. Preferably, the leg member 30 is a rectangular steel tube, but could be formed in other shapes as well, particularly round, with correspondingly shaped holes within the two spaced gussets 16, 17. The top of the leg member 30 has a threaded nut 32 welded into the uppermost portion of the leg member 30. The lowermost portion of the leg member 30 is can be formed with an optional foot that will engage the floor of the production plant and distribute the weight of the form being distributed through the support stand 10.

The frame portion 15 includes a top plate 19 that is formed with an opening therein through which a threaded rod 35 is mounted for rotation relative to the top plate 19. Preferably, the threaded rod 35 includes a necked down portion 36 that projects upwardly through the top plate 19. A first bevel gear 39 is fixed on the necked down portion 36 of the threaded rod 35 and rotates with the threaded rod 35. The bevel gear 39 can be utilized to keep the threaded rod 35 in place relative to the top plate 19. The lower portion of the threaded rod 35 is threadably received within the nut 32 such that the rotation of the threaded rod 35 will cause the threaded nut 32 to translate along the length of the threaded rod 35, which in turn moves the leg member 30 vertically relative to the frame portion 15.

Figure 5:
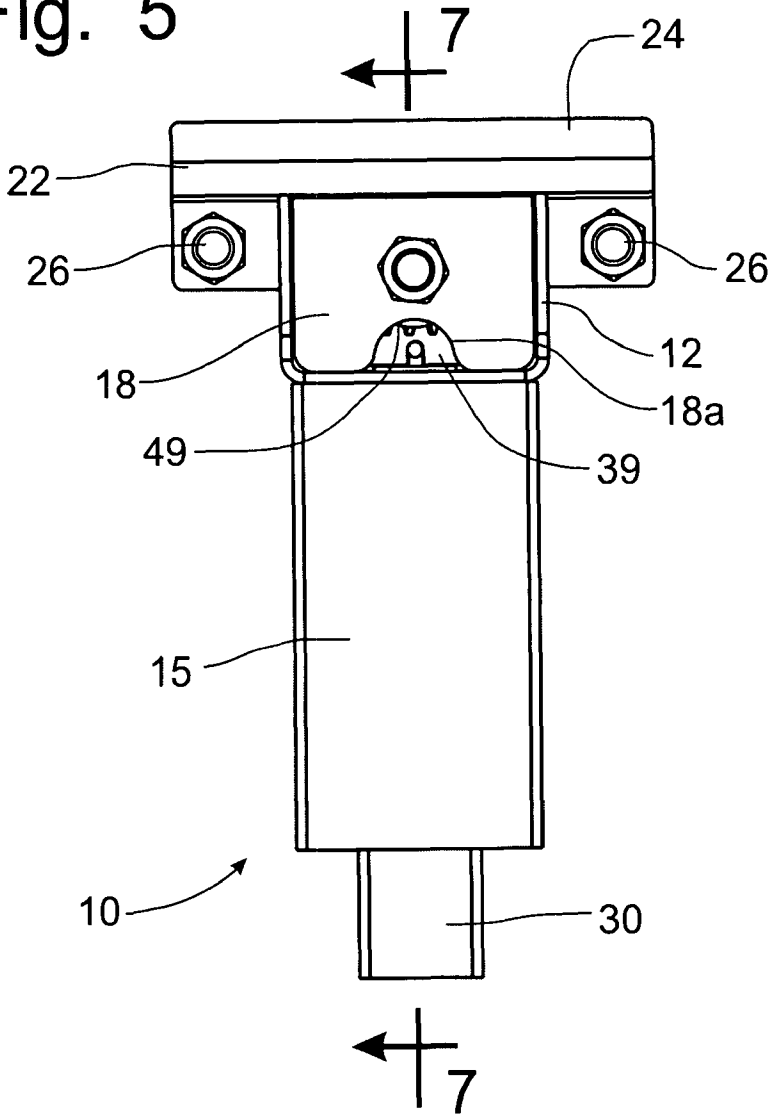
FIG. 5 is an elevational view of the adjustable support stand.
Figure 7:
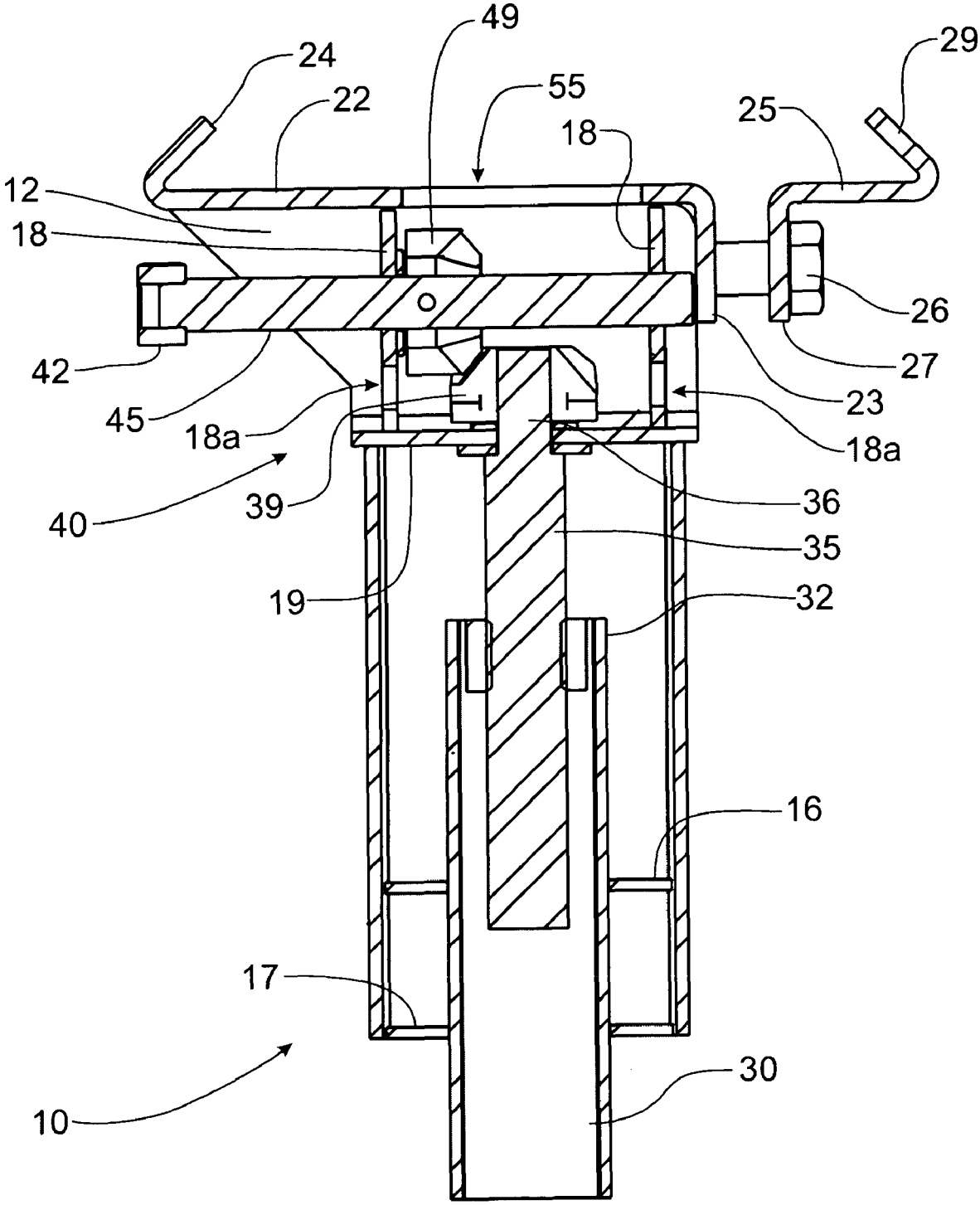
FIG. 7 is a cross-sectional view of the adjustable support stand taken along lines 7-7 of FIG. 5.
Figure 9:
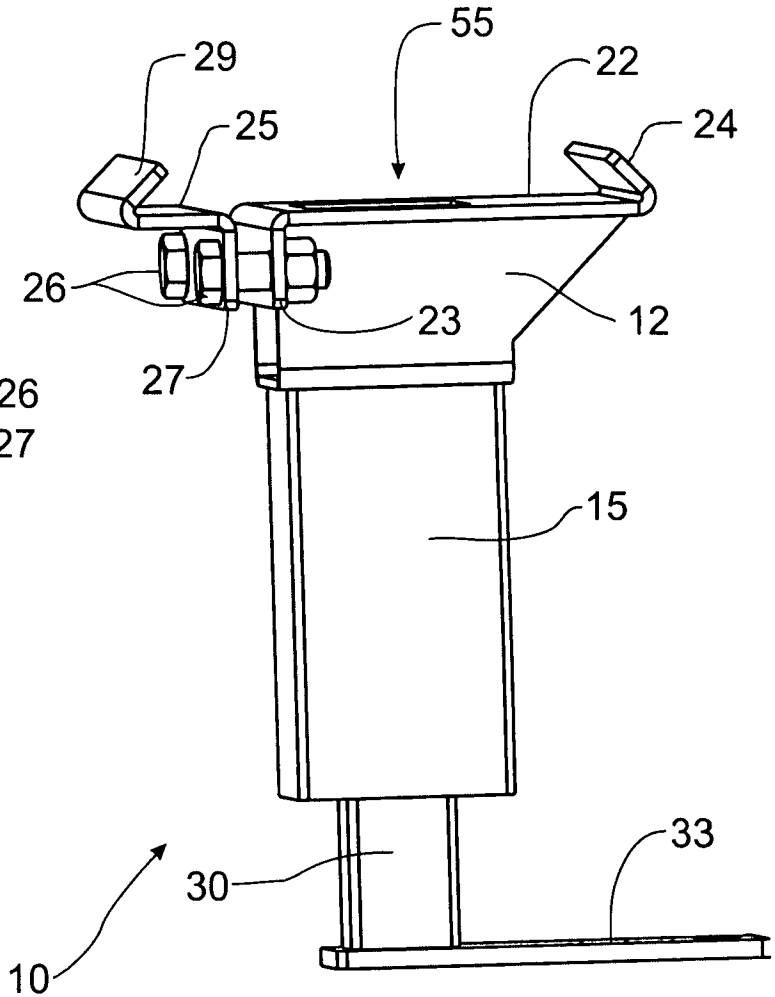
FIG. 9 is a perspective view of the adjustable support stand similar to that of FIG. 4, but incorporating the actuator member depicted in FIG. 8.
Figure 8:
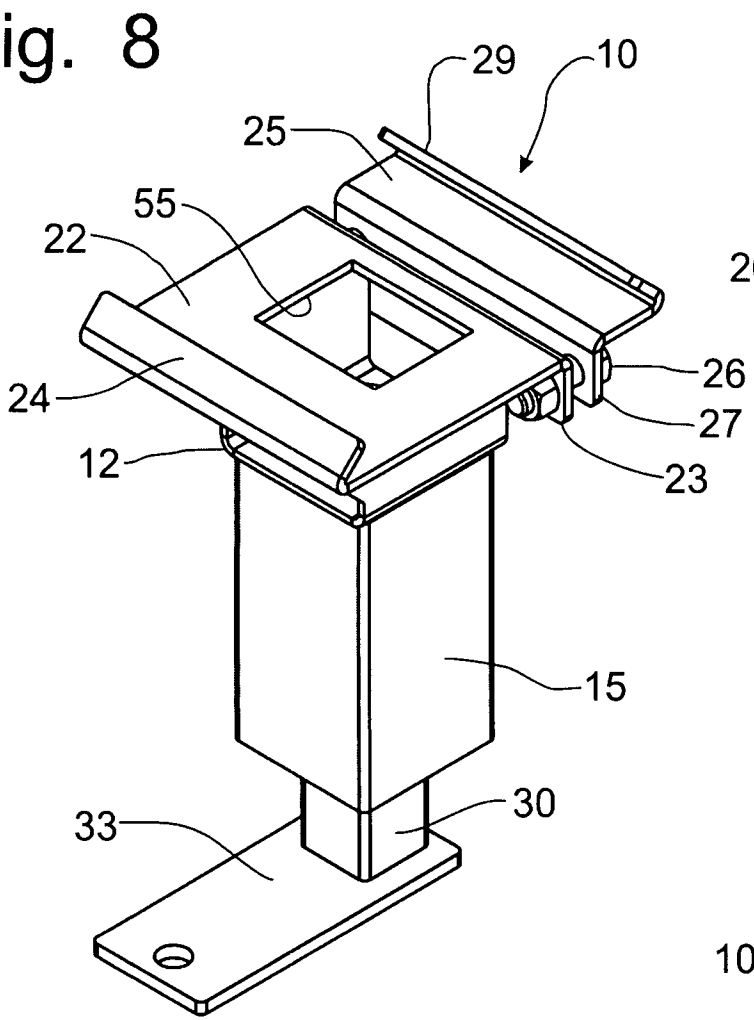
FIG. 8 is an upper perspective view of the adjustable support stand similar to that of FIG. 3, but incorporating a second embodiment of the actuator mechanism.

The first bevel gear 39 forms part of the actuator mechanism 40 for the support stand 10. The actuator mechanism 40 further includes a drive shaft 45 oriented orthogonally to the threaded rod 35 and rotatably supported on laterally spaced vertical supports 18 extending between the top plate 19 and the fixed clamp member 22. As can be seen in FIG. 5, at least one of the vertical supports 18 is formed with a passageway 18*a* that permits the insertion of a retainer pin to secure the first bevel gear 39 to the threaded rod 35. A second bevel gear 49 is fixed on the drive shaft 45 in engagement with the first bevel gear 39 to transfer rotational motion therebetween. The drive shaft 45 preferably includes a fixed driver nut 42 welded on the end of the drive shaft 45 for manipulation by a powered or manually operated hand tool (not shown), such as a ratchet-type socket wrench.

To adjust the vertical length of the support stand 10, the operator places a hand tool on the fixed driver nut 42 at the end of the drive shaft 45 and causes the driver nut 42 to rotate, which in turn causes the drive shaft 45 to rotate therewith. The rotation of the drive shaft 45 drives the second bevel gear 49, which then drives the rotation of the first drive shaft 39. Since the first bevel gear 39 is fixed to the threaded rod 35, the treaded rod 35 rotates to translate the threaded nut 32 along the length of the threaded rod 35. The linear movement of the threaded nut 32 pulls or pushes the leg member 30 through the gussets 16, 17 to retract or extend, depending on the direction of rotation induced to the fixed driver nut 42.

Referring now to FIGS. 8-12, a second embodiment of the actuator mechanism 40 can best be seen. The drive shaft 45, bevel gears 39, 49, and vertical supports 18 rotatably bearing the drive shaft 45 are eliminated and a fixed driver nut 50 is secured, preferably welded, to the uppermost end of the threaded rod 35 in place of the first bevel gear 39. The housing 12 over the top of the frame portion 15 interconnecting the top plate 19 and the fixed clamp member 22 is open beneath the fixed clamp member 22 so that access to the fixed driver nut 50 can be attained via a powered or manually operated hand tool (not shown). Accordingly, this second embodiment of the actuator mechanism 40 is simply a fixed driver nut 50 on the threaded rod 35 that, when rotated by the hand tool, will rotate the threaded rod 35 and cause a corresponding linear movement of the leg member 30 relative to the frame portion 15, as is described above with the threaded nut 32 moving along the length of the threaded rod 35.

Figure 6:
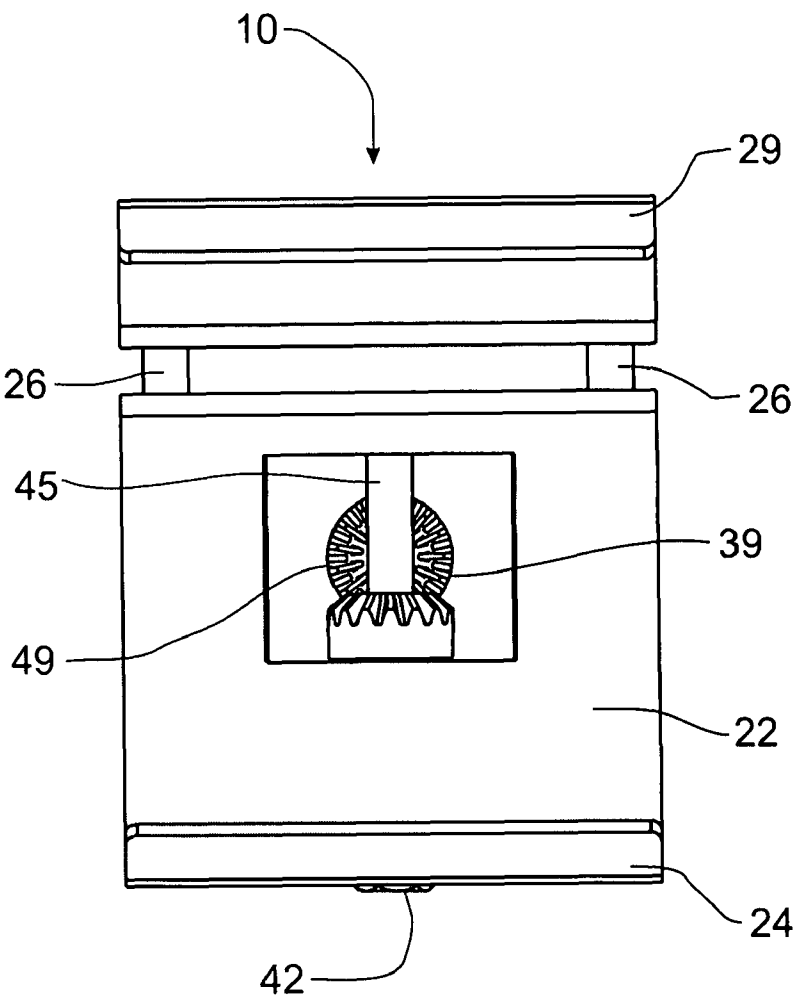
FIG. 6 is a top plan view of the adjustable support stand.
Figures 10, 11:
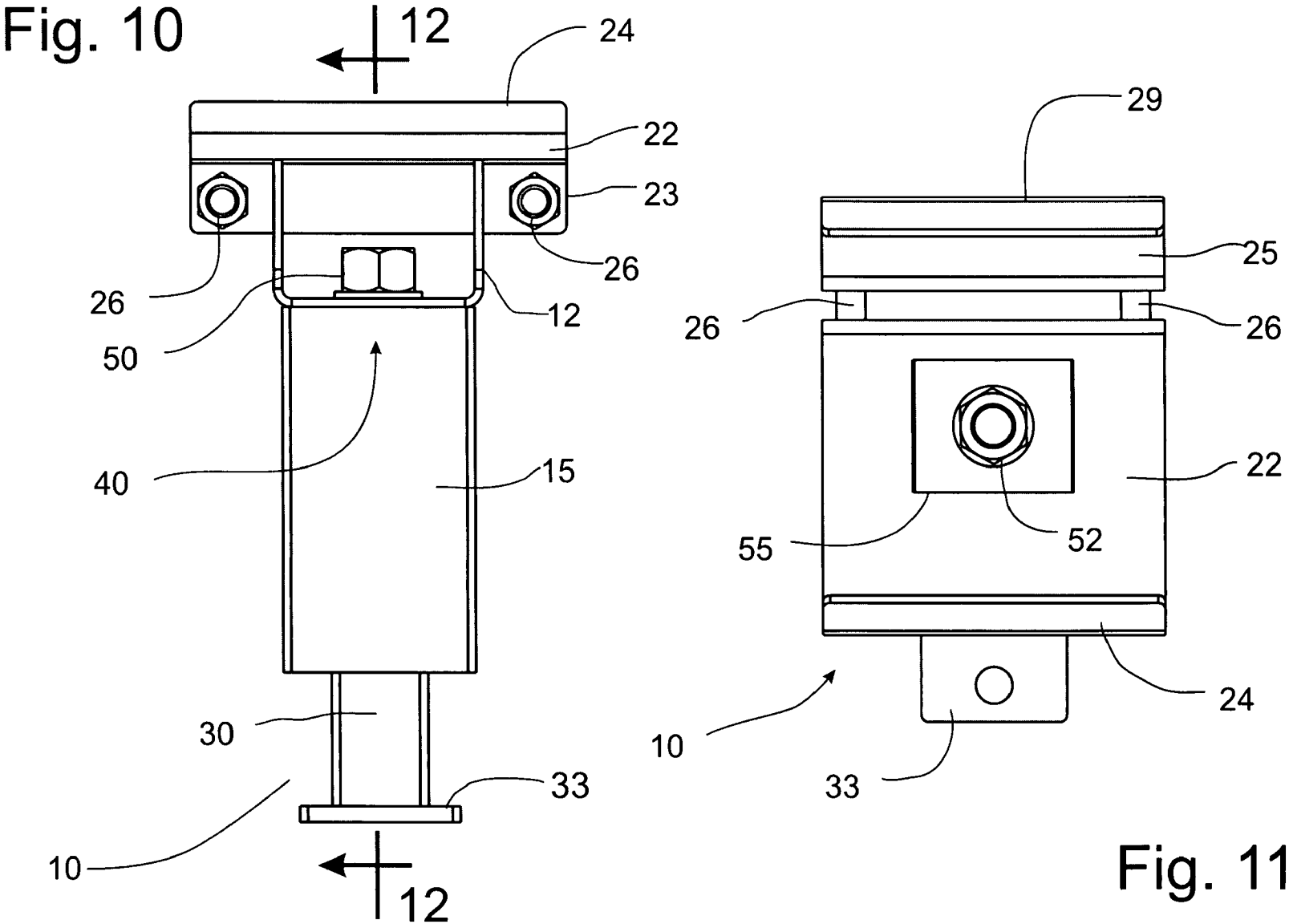
FIG. 10 is an elevational view of the adjustable support stand depicted in FIGS. 8 and 9.
FIG. 11 is a top plan view of the adjustable support stand shown in FIG. 10.
Figure 12:
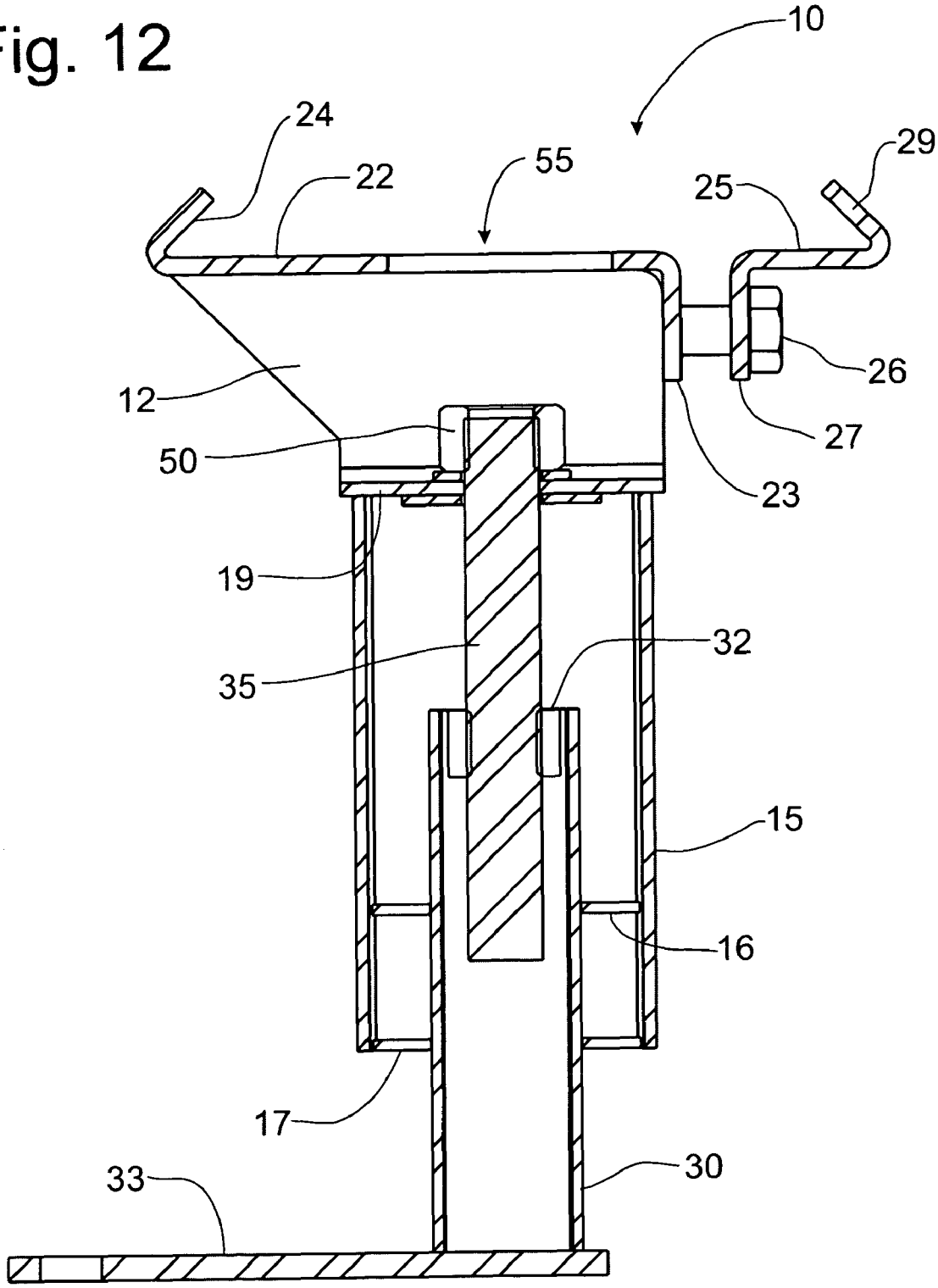
FIG. 12 is a cross-sectional view of the adjustable support stand corresponding to lines 12-12 of FIG. 10.

As is best seen in FIGS. 6 and 11, the fixed clamp member 22 is formed with a vertically oriented opening 55 so that access to the bevel gears 39, 49, or the fixed nut 50 and the threaded rod 35 in the second embodiment of the actuator mechanism 40, can be attained for assembly and/or maintenance purposes.

In operation, proper support of the frame members 5 can be had by simply causing the threaded rod to rotate via either of the embodiments of the actuator mechanism 40 until the foot 33 (or the lowermost end of the leg member 30 if the foot 33 is not utilized) is engaged with the floor of the production plant. More importantly, however, the adjustable support stand 10 will allow the frame members 5 for the form to be leveled very easily by positionally adjusting the height of the appropriate support stand(s) 10 mounted on the frame members 5. Leveling the initial set-up of the form can be done in a shortened amount of time. Furthermore, leveling a re-positioned laterally movable side member (not shown) is also effectively accomplished in the same manner.

The invention of this application has been described above both generically and with regard to specific embodiments. Although the invention has been set forth in what is believed to be the preferred embodiments, a wide variety of alternatives known to those of skill in the art can be selected within the generic disclosure. The invention is not otherwise limited, except for the recitation of the claims set forth below.

Having thus described the invention, what is claimed is:

1. A support stand for a pre-cast concrete wall panel form having a generally horizontally oriented flange, comprising:

a frame portion including a top plate and at least one gusset;

a clamping mechanism mounted to said frame portion to permit a detachable connection of said support stand to said flange on said pre-cast concrete wall panel form, said clamping mechanism including:

a fixed clamp member attached to said frame portion and having a first hook portion for engaging a first beam flange of said pre-cast concrete wall panel form;

a movable clamp member having a second hook portion formed substantially identically to said first hook portion and being oriented in opposition thereto for movement in a direction toward and away from said first hook member for engaging a second beam flange of said pre-cast concrete wall panel form; and fasteners interconnecting said fixed clamp member and said movable clamp member and being oriented parallel to said direction of movement of said movable clamp member to control through threading on said fasteners that provide a variable range of adjustment the positioning of said second hook portion relative to said first hook portion;

a leg assembly supported within said frame portion for linear movement relative thereto, said at least one gusset guiding the linear movement of said leg assembly, said leg assembly including:

a leg member having a threaded member affixed thereto;

a threaded rod rotatably supported on said top plate and engaged with said threaded member so that said threaded member is operable to move along the length of said threaded rod upon rotation of said threaded rod; and a driver nut affixed to an end of said threaded rod to effect rotation thereof; and an actuator mechanism operably coupled to said leg assembly to affect selective linear movement of said leg assembly.

2. The support stand of claim 1 wherein said actuator mechanism comprises:

a drive shaft rotatably mounted on vertical supports extending upwardly from said top plate;

a first gear mounted on said threaded rod; and a second gear mounted on said drive shaft in engagement with said first gear such that the rotation of said drive shaft and said second gear causes a corresponding rotation of said first gear and said threaded rod.

3. The support stand of claim 2 wherein said drive shaft includes a driver nut affixed to a remote end of said drive shaft for access with a tool to cause rotation of said drive shaft.

4. The support stand of claim 1 wherein said driver nut is affixed to an upper end of said threaded rod to cause rotation of said threaded rod when rotated.

5. The support stand of claim 1 wherein said fixed clamp member is supported above said top plate of said frame portion by a housing, said actuator mechanism being accessible through said housing.

6. In a form assembly for manufacturing pre-cast concrete wall panels, said form assembly including I-beam frame members, the improvement comprising:

an adjustable length support stand affixed to each one of a plurality of selected locations on said I-beam frame members, each said adjustable length support stand being operable to vertically position the corresponding said I-beam frame member at a selected height above a fixed reference plane, each said support stand including:

a frame portion including a top plate and at least one gusset;

a leg assembly supported within said frame portion and having a linearly extendable leg member for linear vertical movement relative to said frame portion, said at least one gusset guiding the linear movement of said leg member; and an actuator mechanism operably coupled to said leg assembly to affect selective linear movement of said leg member; and a clamping mechanism mounted to said frame portion to permit a detachable connection of said support stand to said I-beam frame member, said clamping mechanism including:

a fixed clamp member attached to said frame portion and having a first hook portion for engaging a first beam flange of said pre-cast concrete wall panel form;

a movable clamp member having a second hook portion formed substantially identically to said first hook portion and being oriented in opposition thereto for movement in a direction toward and away from said first hook member for engaging a second beam flange of said pre-cast concrete wall panel form; and fasteners interconnecting said fixed clamp member and said movable clamp member and being oriented parallel to said direction of movement of said movable clamp member to control through threading on said fasteners that provide a variable range of adjustment the positioning of said second hook portion relative to said first hook portion.

7. The form assembly of claim 6 wherein said fixed clamp member is supported above said top plate of said frame portion by a housing, said actuator mechanism being accessible through said housing.

8. The form assembly of claim 7 wherein said leg assembly comprises:

said leg member having a threaded member affixed thereto; and a threaded rod rotatably supported on said top plate and engaged with said threaded member so that said threaded member is operable to move along the length of said threaded rod upon rotation of said threaded rod.

9. The form assembly of claim 8 wherein said actuator mechanism comprises:

a drive shaft rotatably mounted on vertical supports extending upwardly from said top plate;

a first gear mounted on said threaded rod; and a second gear mounted on said drive shaft in engagement with said first gear such that the rotation of said drive shaft and said second gear causes a corresponding rotation of said first gear and said threaded rod.

10. The support stand of claim 9 wherein said drive shaft includes a driver nut affixed to a remote end of said drive shaft, said drive shaft projecting outwardly of said housing to locate said driver nut externally of said housing.

11. The support stand of claim 8 wherein said actuator mechanism comprises:

a driver nut affixed to an upper end of said threaded rod to cause rotation of said threaded rod when rotated, said housing being open on at least one side thereof to permit access to said driver nut.

* * * * *